US006478336B2

(12) United States Patent
Tran

(10) Patent No.: US 6,478,336 B2
(45) Date of Patent: Nov. 12, 2002

(54) SHALLOW BOX BINDER COVER

(76) Inventor: Lam H. Tran, 7525 Oaktree Ave., Westminster, CA (US) 92683

( * ) Notice: Subject to any disclaimer, the term of this patent is extended or adjusted under 35 U.S.C. 154(b) by 52 days.

(21) Appl. No.: 09/728,386

(22) Filed: Dec. 4, 2000

(65) Prior Publication Data

US 2002/0076261 A1 Jun. 20, 2002

(51) Int. Cl.[7] ..... B65D 85/67

(52) U.S. Cl. ..... 281/29; 281/22; 281/31; 281/32; 402/70; 402/73; 40/124.06; 40/653; 40/654.01; 40/405; 40/722; 40/724; 40/726; 40/797

(58) Field of Search ..... 281/22, 29, 31, 281/32; 402/70, 73; 40/124.06, 653, 654.01, 405, 722, 724, 726, 797

(56) References Cited

U.S. PATENT DOCUMENTS 2,801,115 A * 7/1957 Federbush et al. ..... 281/31
2,850,294 A * 9/1958 Ortis et al. ..... 281/31
4,001,960 A * 1/1977 Holson ..... 281/31
4,164,085 A * 8/1979 Steeb et al. ..... 281/31
5,823,330 A * 10/1998 Werner et al. ..... 206/232
5,857,797 A * 1/1999 Streff et al. ..... 281/31
6,106,014 A * 8/2000 Werner et al. ..... 281/22
6,142,696 A * 11/2000 Tan ..... 402/70
6,267,413 B1 * 7/2001 Tran ..... 281/29

* cited by examiner

*Primary Examiner*—A. L. Wellington
*Assistant Examiner*—Mark T. Henderson
(74) *Attorney, Agent, or Firm*—Charles H. Thomas

(57) ABSTRACT

A shallow box binder cover is provided for a binder containing a plurality of pages. The cover has a stiff, opaque core through which a plurality of display openings are defined. These display openings are surrounded by the structure of the cover core. A separate transparent plastic blister or box is located in each of the display openings. Each transparent box has a raised interior bubble surrounded by a base having mounting flanges projecting laterally from opposite sides of the periphery of the base. These mounting flanges are held against the inside surface of the front cover core so that the raised interior bubbles project into the display openings and into close proximity to the outer surface of the cover core. A front cover liner is disposed across the bases of the boxes to define separate, hollow enclosed cavities within the interior portions of each of the bubbles. Selected three-dimensional objects are placed within the bubbles before the front cover liner is disposed across the bases of the boxes. These three-dimensional objects are thereby loosely entrapped within the bubble portions of the boxes in the display openings and are visible from the front of the binder cover.

15 Claims, 6 Drawing Sheets

SHALLOW BOX BINDER COVER

BACKGROUND OF THE INVENTION

1. Field of the Invention

The present invention relates to an improved cover for a document binder, such as an album, a notebook, a spiral binder, a loose leaf binder, and other types of binders that employ a stiff front cover.

2. Description of the Prior Art

Conventional hard cover binders are usually formed with a flat, expansive, rectangular front cover core, often formed of chipboard, fiber board, cardboard, plastic, or some other stiff material. In some cases the cover core forms the sole structure of the front cover. Often, however, the cover core has a planar outside surface covered with a film of plastic or a layer of fabric. The planar inside surface of the cover core is often covered with an inside cover liner formed of paper or a sheet of plastic.

Very typically the front cover of a binder is formed as a flat, unbroken expanse, often imprinted with a title or some other identifying indicia. In some cases the front cover may be constructed with a transparent title sheet-retaining overlay and a title sheet inserted in between the overlay and the stiff portion of the front cover. However, conventional front covers of the binders have a decidedly two-dimensional appearance.

SUMMARY OF THE INVENTION

The present invention provides a front binder cover with a unique, three-dimensional appearance. According to the invention, display openings are defined in the front cover core and transparent plastic blisters or boxes are located in the these display openings. Three-dimensional objects may be positioned in these transparent blisters or boxes. Each blister has a hollow, concave bubble portion surrounded by a base. The bubbles are initially open on the base side which is located at the inside surface of the front cover core. This allows insertion of a three-dimensional object into the bubble. The base side of the bubble or blister is thereafter closed by an inner front cover liner or closure panel to form an enclosed box having a transparent roof that serves as a window into the box. The three-dimensional object positioned in the box is thereby visible to an observer when the binder is closed.

While the front cover core may be formed with a single display opening, more typically the cover core is provided with a plurality of such openings. Groups of related objects such as dried flowers, seeds, photographs, collectible pins, badges, medallions and innumerable other small objects and articles may be positioned in the boxes located in the front cover. These objects are preferably loosely encapsulated within the boxes so that they exhibit some movement within their confines when the cover is opened and closed. This adds to the three-dimensional effect created. The binder thereby has a far more unique and interesting appearance as contrasted with conventional binders that are only imprinted with two-dimensional lettering or designs.

In one broad aspect the present invention may be considered to be a shallow box document binder cover having a front cover core formed as a flat structure having inside and outside surfaces and defining at least one display opening therethrough surrounded by the structure of the front cover core. A blister formed of stiff, resilient transparent plastic is provided which has a base, a raised interior bubble portion projecting outwardly from the base, and flat base flanges projecting in opposing lateral directions from the bubble portion. The bubble portion is positioned to project into the display opening from the inside surface of the front cover core with the base flanges residing in contact with the inside surface of the front cover core. A base closure member is provided which extends across the base of the blister to define a hollow cavity within the bubble portion of the blister.

In preferred embodiments of the shallow box document binder cover of the invention, the front cover core is provided with a plurality of display openings of the type described. Each of these display openings is provided with a separate blister of the type described. The front cover thereby has the appearance of a flat cover surface in which a plurality of transparent enclosures are formed. Each transparent enclosure contains a separate three-dimensional article or object which is loosely trapped in the hollow cavity formed by the blister and the base closure across the base of the blister at the inside surface of the front cover core. These three-dimensional articles or objects are normally different from each other in some way.

The bubble portion of the blister has a shape that conforms to the shape of the display opening. For example, the display opening may have a square shape so that the bubble portion of the blister also has a square configuration when viewed through its exposed transparent side. The transparent, exposed roof of the bubble portion of the blister may project through the display opening and beyond the outer surface of the front cover core to thereby a form an enclosing cavity for the three-dimensional object that is thicker than the front cover core. Alternatively, the transparent, exposed roof of the bubble portion of the blister may reside in coplanar relationship with the outer surface of the front cover. In some instances the box cavity may be extremely shallow and the transparent roof of the bubble portion of the blister may be recessed below the level of the outer surface of the front cover.

The base flanges of the transparent blister prevent the blister from passing entirely through the display opening and are often utilized to secure the blister firmly in position anchored to the front cover core. Mutually engaging hook and fabric fastening strips, such as those sold under the registered trademark, Velcro®, may be utilized to attach the base flanges to the inside surface of the front cover core. Alternatively, an adhesive may be utilized for this same purpose instead.

In another arrangement, however, the bubble portion of the blister may include a lip that extends laterally from opposing sides of the periphery of the top or roof of the bubble portion. The lip is separated from the base flanges by a distance equal to the thickness of the front cover core. In this way the lip and the base flanges grip the front cover core at the perimeter of the display opening when the bubble portion of the blister is inserted into the display opening from the inside surface of the front cover core. Alternatively, the base flanges can be flexed and inserted from the outside of the cover into the display opening. In any event, either the structure of the front cover core or the structure of the blister must be elastically resilient enough to permit passage of either the lip or the flanges through the display opening. Once the lip clears the outer surface or the flanges clear the inner surface of the front cover core, the blister is immobilized in the display opening by the gripping contact established by the lip against the outside surface of the front cover core and the contact of the base flanges against the inside surface of the front cover core.

In other embodiments of the invention the blister may be secured immovably in position relative to the front cover core by an inner cover liner that extends across the inside surface of the front cover core. This liner also serves as the base closure to the blister. The liner may be secured by adhesive to both the inside surface of the front cover core and to the base flanges of the transparent blister. In these embodiments of the invention the inner cover liner permanently seals off the hollow cavities formed within the blisters. In such embodiments the three-dimensional articles or objects must be placed in the blister enclosures during manufacture of the front binder cover, and cannot be changed.

Other embodiments of the invention allow a user to customize the front binder cover of the invention. In these embodiments the base closure member may be formed as a stiff panel that is thinner than the front cover core. This panel may be set into a recessed area of the front cover core and held in position by friction, hook and loop fabric fasteners, pressure sensitive adhesive, or swivel tabs. Alternatively, the panel may be hinged to the inside surface of the front cover core and rotated to a position closing off the cavity defined within the structure of the blister by covering the base of the blister, or alternatively to a position exposing the base of the blister.

The invention may be described with greater clarity and particularity by reference to the accompanying drawings.

DESCRIPTION OF THE EMBODIMENT

Figure 1:
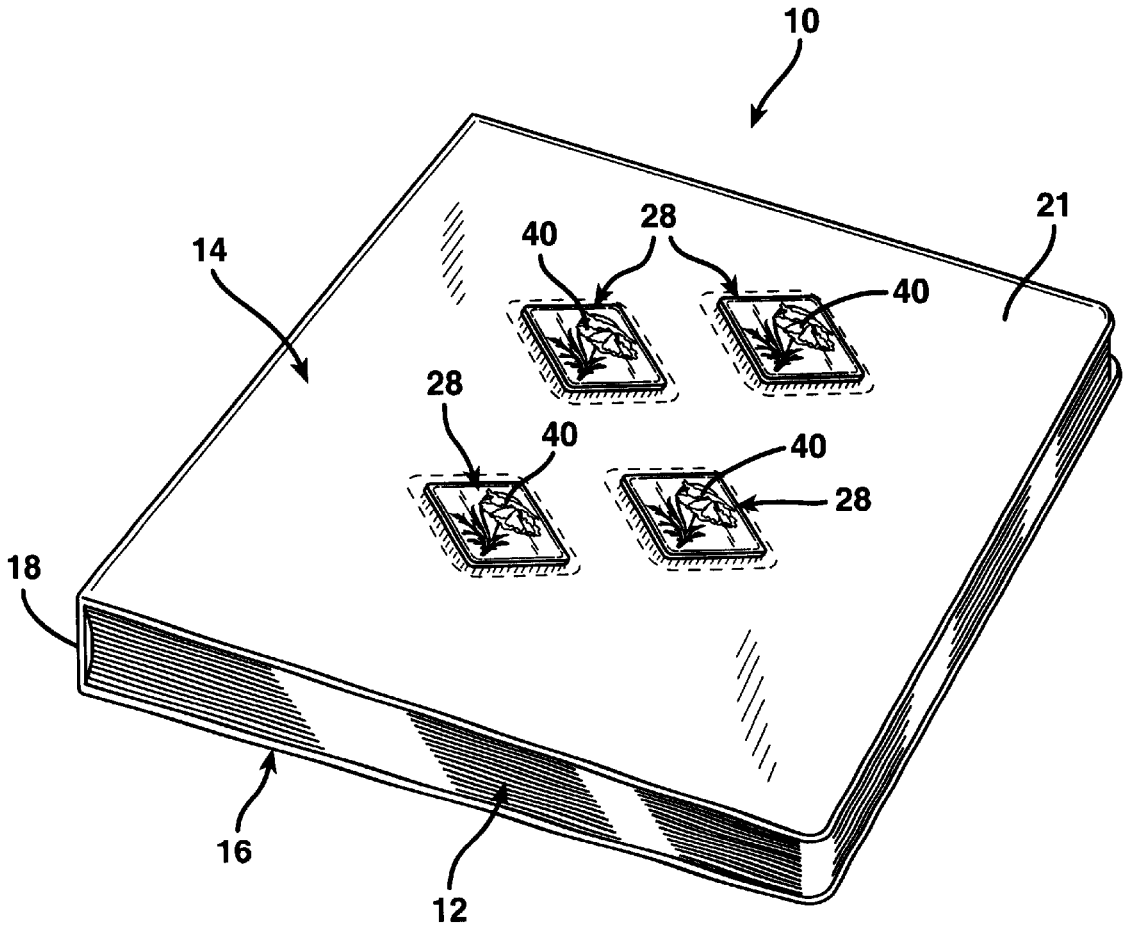
FIG. 1 is a perspective view of a binder employing one preferred embodiment of the shallow box binder cover of the invention.

FIG. 1 illustrates a binder 10 for a plurality of pages indicated collectively at 12. The binder 10 is formed with a hard front cover 14, a back cover 16, and a spine 18 joined together in articulated fashion in a conventional manner. The front cover 14, the back cover 16, and the spine 18 are all formed as stiff, opaque generally rectangular structures.

Figure 2:
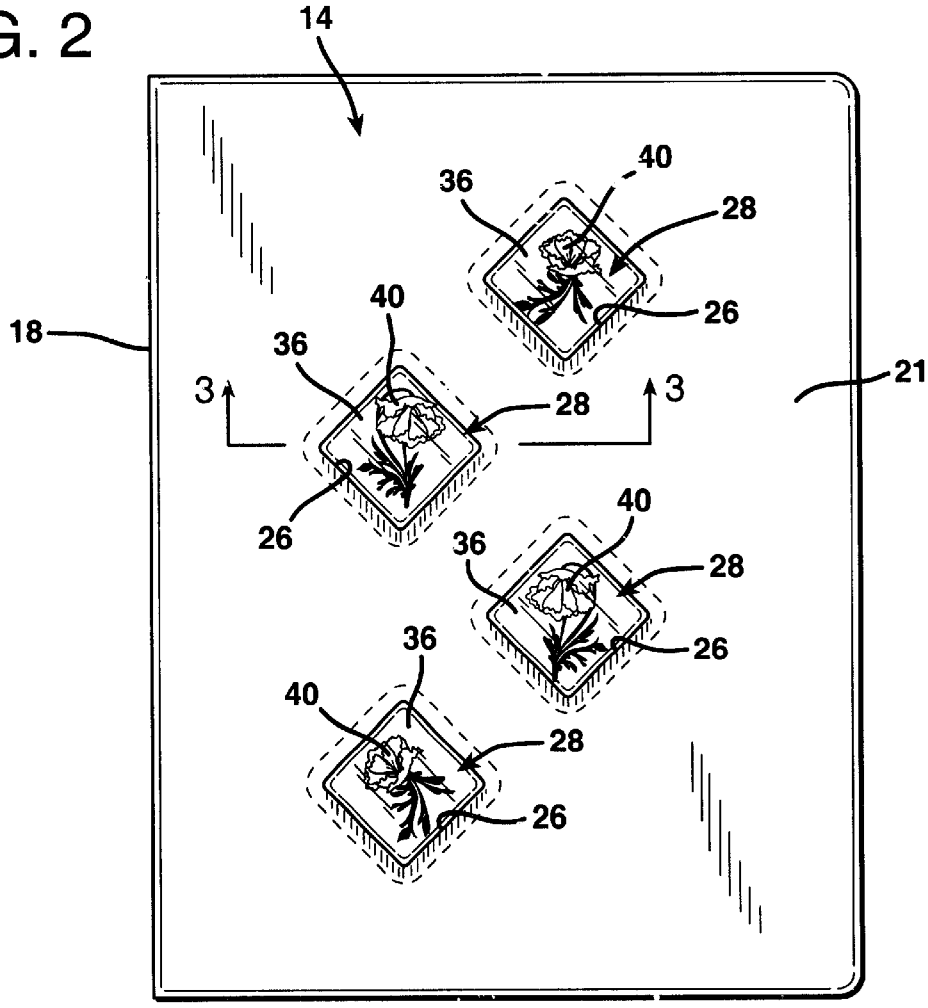
FIG. 2 is a top outside plan view of the front cover of the binder shown in FIG. 1.
Figure 3:
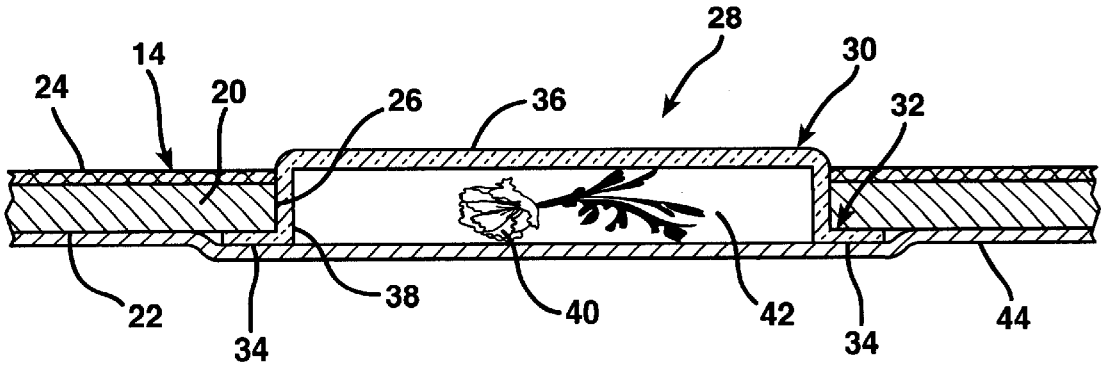
FIG. 3 is a sectional elevational detail taken along the lines 3—3 in FIG. 2.
Figure 4:
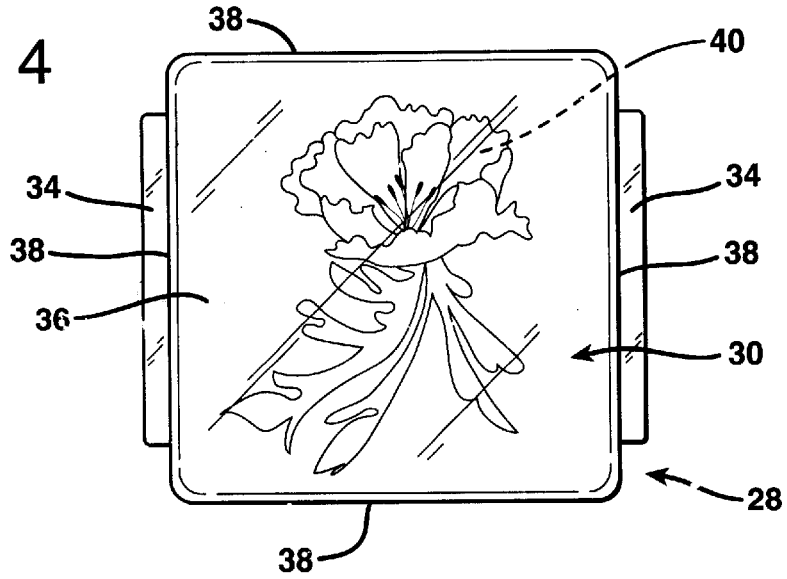
FIG. 4 is a top plan detail view illustrating the transparent plastic blister employed in the embodiment of FIGS. 1–3.

As best illustrated in the detail view of FIG. 3, the front cover 14 is comprised of a broad, flat, expansive chipboard core 20 having a flat, planar inside surface 22 and an opposing flat, planar outside surface 24. As with conventional cover cores, the front cover core 20 is covered with a thin, exterior, outside protective fabric layer 21. Unlike conventional binder cover cores however, a plurality of square display openings 26 are defined entirely through and within the surrounding structure of the front cover core 20. In the embodiment illustrated, there are four separate display openings 26 defined through the core 20 arranged in an aesthetically appealing pattern, as illustrated in FIG. 2.

Figure 5:
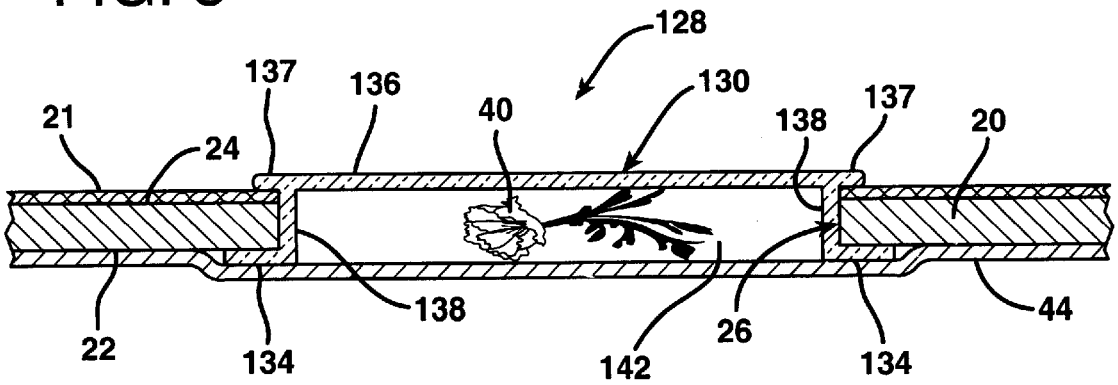
FIG. 5 is a sectional elevational detail illustrating an alternative embodiment of the front binder cover to that depicted in FIGS. 1–4.

A separate, transparent plastic blister or box 28 is located in each of the display openings 26. As illustrated in FIG. 3, each of the transparent blisters 28 has a raised, interior bubble portion 30 surrounded by a base 32. The base 32 must have at least one mounting flange projecting laterally from opposite sides of the periphery of the base. In the embodiment illustrated the base 32 has a flat, narrow mounting flange or foot 34 projecting laterally outwardly away from the bubble 30 from two opposing sides, as best illustrated in FIG. 5. The bubble portion 30 of each blister or box 28 is formed as a shallow, transparent tray defining a roof 36 and walls 38. The laterally projecting planar flanges or feet 34 of the base 32 extend away from the walls 38 in a plane parallel to that of the roof 36.

The raised, interior bubble portion 30 of each blister 28 projects into and is located within the lateral confines of a separate one of the display openings 26 in the front cover core 20, as illustrated in FIGS. 1 and 2. Each of the display boxes or blisters 28 is formed of a stiff, transparent plastic material, such as polypropylene or polyethylene. The boxes or blisters 28 may be shaped so that each of the enclosed cavities defined therewithin has the shape of a rectangular prism. In the embodiments illustrated, the blisters 28 are formed with substantially square exposed roofs 36 surrounded by four short walls 38 that extend from the roof 36 to the base 32. The walls 38 are oriented perpendicular to the plane of the expansive cover core 20 and are slightly greater in length than the thickness of the cover core 20. As a consequence, the roof 36 of each blister 28 resides .in a plane located slightly beyond the outside surface 24 of the cover core 20.

The dimensions of the bubble portions 30 of the blisters 28 closely conform to the dimensions of the display openings 26. As a consequence, the walls 38 which form the sides of the bubble portion 30 of the blisters 28 fit snugly into the confines formed by the display openings 26. A fairly secure frictional fit is thereby-established-that holds the blisters 28 in position within the display openings 26 with the bubble portions 30 projecting outwardly through the display openings 26.

In the embodiment of FIGS. 1–3, a three-dimensional object, for example a dried flower 40, is placed within the each of the bubble portions 30 of the blisters 28. At this point in the fabrication of the cover 14 an inner front cover liner 44. is then coated with adhesive and laid across the inside surface 22 of the front cover core 20 and across the bases 32 of the blisters 28. The inner front cover liner 44 is thereby adhesively sealed to the inside surface 22 of the front cover core 20, as well as to the facing surfaces of the blister flanges 34, as illustrated in FIG. 3. The inner cover liner 44 thereby serves the function of a blister or box base closure so that separate, hollow, enclosed cavities 42 are formed within the interiors of each of the bubble portions 30. The raised, interior bubbles 30 project into the display openings 26 and the front cover liner 44 is disposed across the bases 32 of the blisters or boxes 28.

In FIG. 5 an alternative embodiment of a blister or box 128 is illustrated. In this embodiment the bubble 130 also has a flat roof 136, but in addition a lip 137 that extends laterally from each of two of the opposing walls 138 of the box 128 in the plane of and at the periphery of the roof 136. Each lip 137 is separated from the laterally projecting base flanges 134 by a distance such that the lips 137 and the base flanges 134 grip the front cover core 20 and the fabric outer cover layer 21 at the perimeter of the display openings 26. The plastic material of which the box 128 is constructed and the chipboard forming the front cover core 20 are sufficiently resilient to permit passage of the lip 137 through the display opening 26 when the bubble 130 is inserted into the display opening 26 from the inside surface 22 of the cover core 20. Once the lips 137 clear the fabric layer 21, the edges of the structure of the cover core 20 and the fabric layer 21 surrounding the display opening 26 are seated against the outer surfaces of the walls 138 and are gripped between the lips 137 and the base flanges 134. The box 128 is thereby locked in position relative to the cover core 20. The open side of the box 128 is closed by the inner front cover liner 44 as previously described. The three-dimensional article or object 40 is thereby permanently entrapped within the enclosed cavity 42.

Figure 5A:
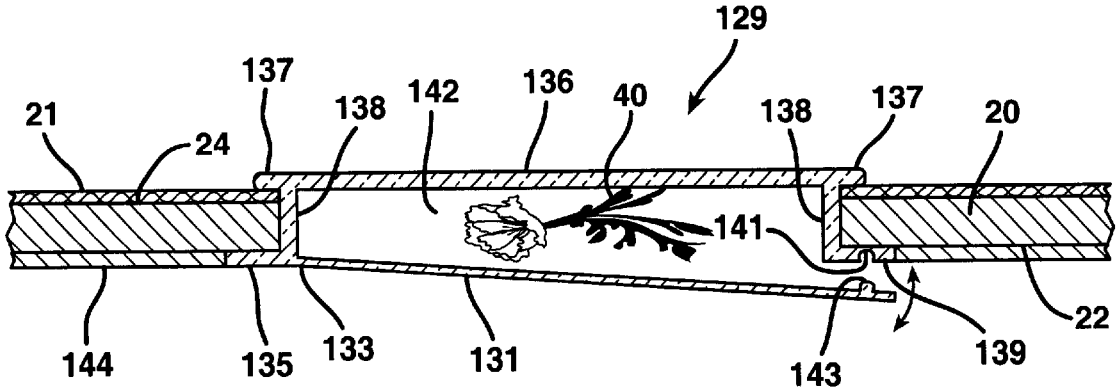
FIG. 5A is a sectional elevational detail illustrating an alternative embodiment of the front binder cover to that depicted in FIG. 5.

FIG. 5A illustrates a modification of the embodiment shown in FIG. 5. The blister or box 129 shown in FIG. 5A is similar in many respects to the blister 128 depicted in FIG. 5. However, the blister 129 is equipped with a rectangular, bottom closure panel 131 that forms a hinged connection 133 with the flange 135. The opposing flange 139 has a small, shallow, generally cylindrically-shaped detent recess 141 defined in its inwardly facing surface. At its extremity remote from the hinged connection 133, the closure panel 131 has a corresponding, outwardly directed detent pin 143 projecting from the surface that contacts the flange 139. The detent pin 143 may be engaged in the detent recess 141 with a releaseably engageable friction fit to close off the enclosure cavity 142 of the blister 129. Instead of extending across the entire inside surface 22 of the front cover 14, the inner cover liner 144 has a rectangular opening defined therein to receive the flanges 135 and 139, as well as the flat closure panel 131 therewithin. It is thereby evident that a user may insert an article 40 into the cavity 142, and replace that article if desired, merely by lifting and closing the free extremity of the cavity enclosure panel 131. This allows the user the flexibility of customizing the front cover of the binder as desired.

Figure 6:
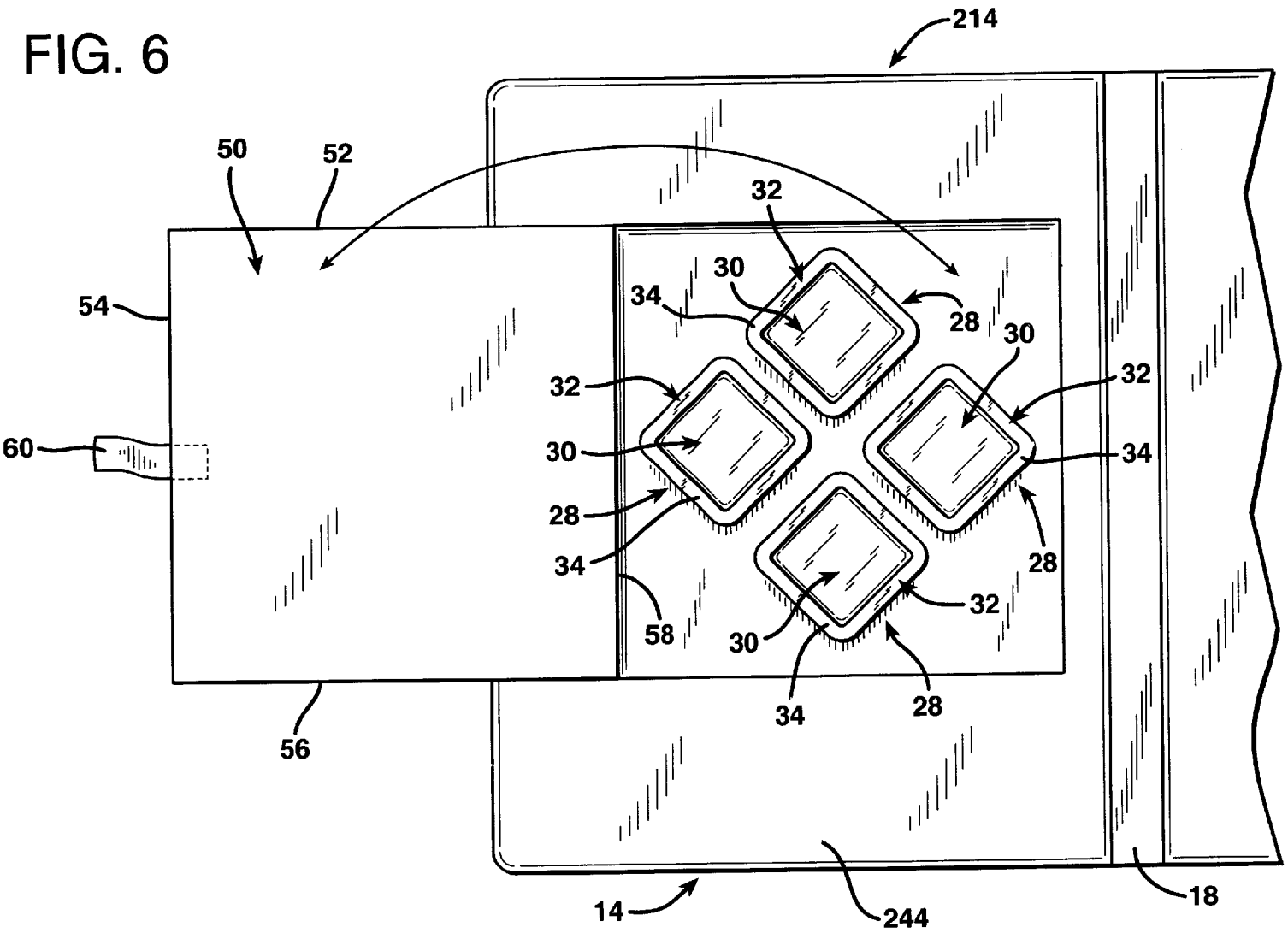
FIG. 6 is an inside plan view illustrating another alternative embodiment of a front binder cover according to the invention employing a hinged panel which is shown in the open position.
Figure 7:
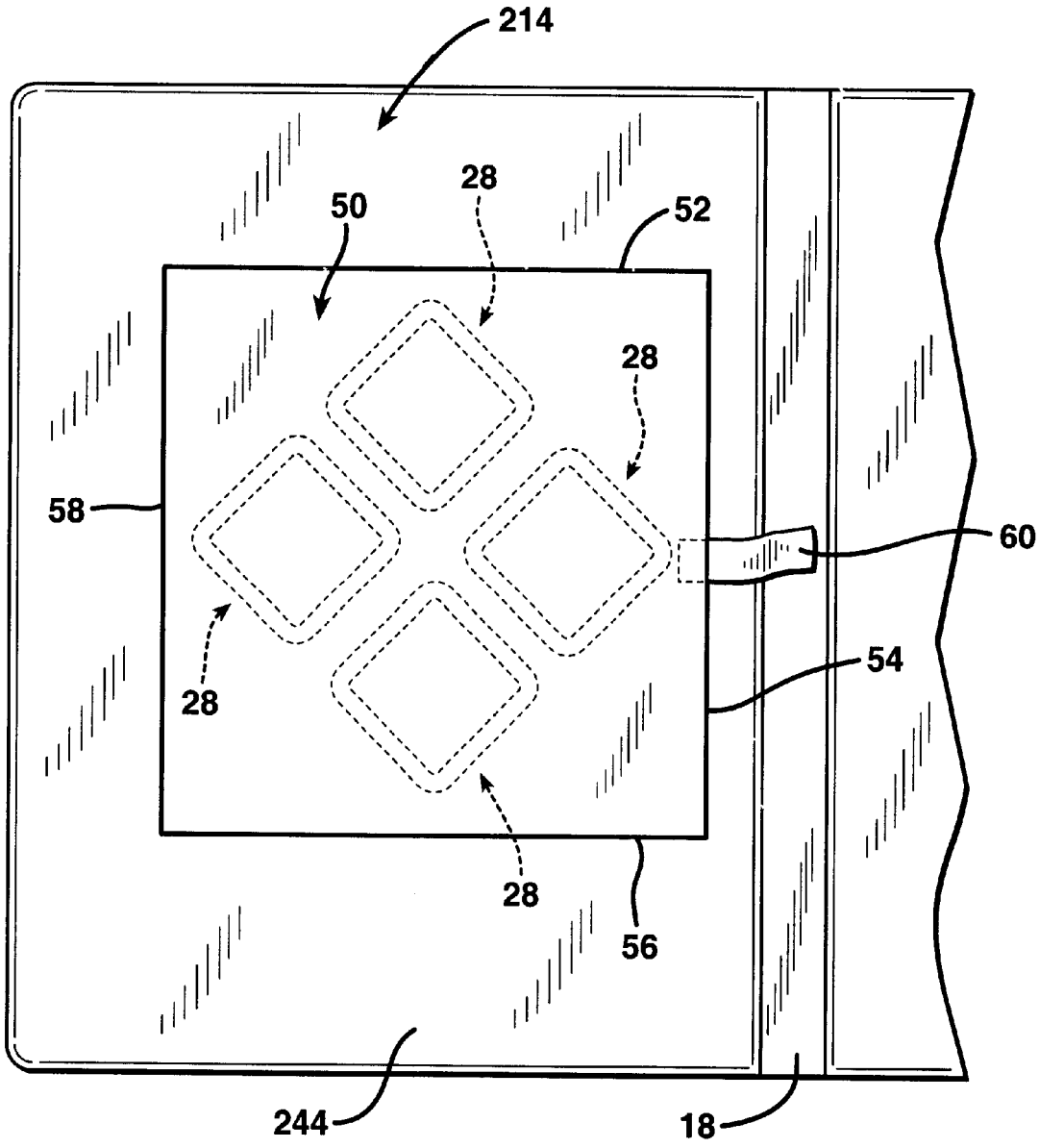
FIG. 7 is an inside plan view of the inside of the front binder cover of FIG. 6 shown with the panel closed.

FIGS. 6 and 7 illustrate another alternative embodiment of the invention. As shown in those drawing figures a relatively large, square panel 50 is formed in the inner cover liner 44. The panel 50 is formed by die cutting on three sides 52, .54 and 56. The side 58, parallel to the side 54, is left uncut so that it forms a hinge connection to the remaining structure of the inner front cover liner 244.

The material forming the inner liner 244 and the panel 50 is stiff enough so that the panel 50 may be rotated about the hinge connection at its side 58 relative to the inside surface 22 of the front cover core 20. The hinged panel 50 is thereby movable to an open position exposing the bases 32 of the blisters or boxes 28, as illustrated in FIG. 6. This allows a user to customize the front cover 214 by placing articles of the user's choice within the boxes 28. The panel 50 has a fabric ribbon pull tab 60 at the edge 54 remote from the inner hinged edge 58. Once the user has placed the selected articles into the blisters 28, the user swings the panel 50 shut from the position of FIG. 6 to the position of FIG. 7 using the ribbon pull tab 60. The structure of the panel 50 is rigid enough to remain in a friction tight fit within the confines of the remaining structure of the inner cover liner 244 along its die cut edges 52, 54, and 56. When the panel 50 is moved to the closed position shown in FIG. 7, it resides in contact with the bases 32 of the blisters or boxes 28. Each of the three-dimensional objects 40 will thereby be isolated within a single box 28, but can be replaced if desired.

Figure 8:
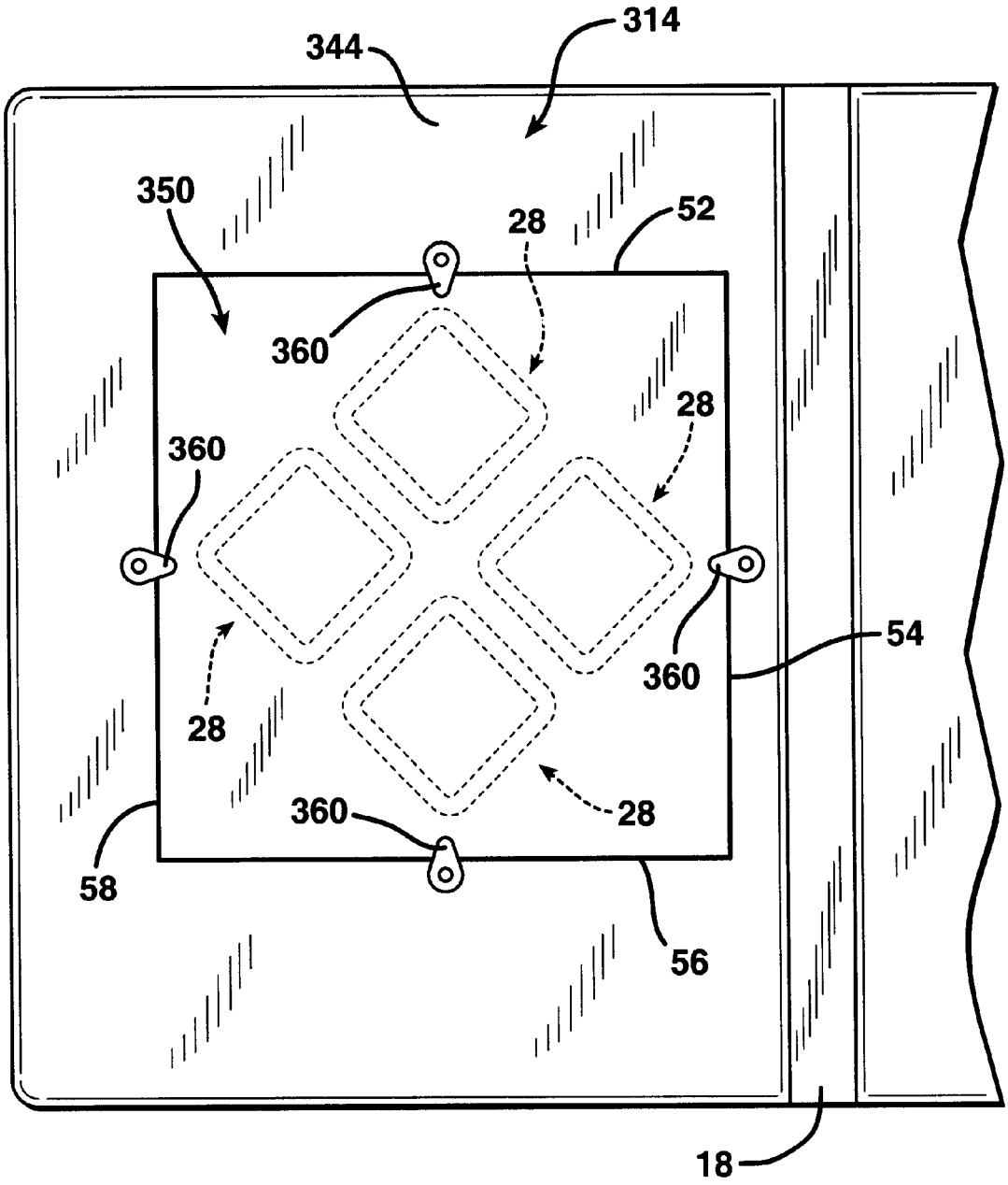
FIG. 8 illustrates an alternative embodiment of the invention to that depicted in FIGS. 6 and 7.

FIG. 8 illustrates another embodiment of the invention showing the inside of a front cover 314 having an inner cover liner 344 from which a panel 350 has been cut. The panel 350 differs from the panel 50 in the embodiment of FIGS. 6 and 7 in that it is cut completely free from the remaining structure of the inner cover liner 344. The panel 350 is thereby completely removable from the cover 314 to allow full exposure of the tray like structures formed by the blisters 28 located therebeneath. A user can selectively place articles into the blisters 28 when the panel 350 is removed from the remaining structure of the cover 314. Once the articles are positioned in the blisters 28, the panel 350 is inserted back into the opening defined in the inner cover liner 344 in contact with the bases 32 of the blisters 28.

In the embodiment of FIG. 8, the panel 350 is held in position by swivel locking tabs 360. The tabs 360 are rotated about their axes which are oriented perpendicular to the cover 344 to allow removal of the panel 350 to change the articles that are positioned in the boxes 28. The panel 350 is thereby movable between an open position exposing the feet or flanges 34 of the tray-like blisters 28 and a the closed position shown in FIG. 8 defining enclosed cavities 42 within each of the boxes 28, as previously described.

Undoubtedly, numerous variations and modifications of the invention will become readily apparent to those familiar with binders, notebooks, and other office supply products. For example, the display openings can be die cut as round openings and the bubbles formed by the blisters can be generally hemispherical in shape. Also, the opening 26 that is die cut through the structure of the front cover 14 may be die cut at an angle, so that the walls of the blister or box are not perpendicular to the roof of the blister, as are the walls 38 and 138 in the embodiments illustrated. Rather the opening can be die cut at an angle so that the perimeter of the opening on the outside surface 24 is slightly larger than the perimeter of the opening on the inside surface 22 of the front cover. When the display opening is cut in this manner, the structure of the blister or box does not have the shape of a rectangular prism, but rather the shape of a truncated pyramid. That is, the side walls of the blister may slope in converging fashion from the outside toward the inside of the binder core. Numerous other variations and modifications of the invention are also possible. Accordingly, the scope of the invention should not be construed as limited to the specific embodiments depicted and described, but rather is defined in the claims appended hereto.

I claim:

1. A shallow box document binder cover having a front cover core formed as a flat structure having inside and outside surfaces and defining at least one display opening therethrough surrounded by said structure of said front cover core, and a blister formed of stiff, resilient, transparent material and having a base, a raised interior bubble portion projecting outwardly from said base, and flat base flanges projecting in opposing lateral directions from said bubble portion, and said bubble portion projects into said display opening from said inside surface of said front cover core with said base flanges residing in contact with and secured to said inside surface of said front cover core, wherein said display opening and said bubble portion of said blister both have a square shape, and wherein said bubble portion includes a lip that extends laterally from opposing sides of the periphery of said bubble portion and said lip is separated from said base flanges by a distance such that said lip and said base flanges grip said front cover core therebetween, and a base closure member extends across said base of said blister to define a hollow cavity within said bubble portion of said blister.

2. A shallow box document binder cover according to claim 1 further comprising a plurality of display openings as aforesaid in said front cover core and each of said display openings is provided with a separate blister as aforesaid.

3. A shallow box document binder cover according to claim 1 wherein said bubble portion projects through said display opening and beyond said outer surface of said front cover core.

4. A shallow box document binder cover according to claim 1 further comprising a three-dimensional object loosely entrapped in said hollow cavity.

5. A shallow box document binder cover according to claim 1 further comprising an inner cover liner that extends across said inside surface of said front cover core and which also serves as said base closure to said blister.

6. A shallow box document binder cover according to claim 1 wherein said base closure member is a stiff panel that is thinner than said front cover core and is hinged to said inside surface of said front cover core and said panel is rotatable to a position closing said cavity and covering said base of said blister -and alternatively to a position exposing said base of said blister.

7. A shallow box document binder cover according to claim 1 wherein said base closure member is a panel that is hinged to one of said flat base flanges and which extends therefrom to meet the remaining ones of said flat base flanges, and said hinged panel is releaseably engageable to enclose and to alternatively expose said hollow cavity.

8. A binder for a plurality of pages comprising a stiff, opaque front cover having a front cover core with inside and outside surfaces and a plurality of display openings are defined entirely through said front cover core and are laterally surrounded by said front cover core, and a separate transparent box is located in each of said display openings and each transparent box has a raised interior bubble surrounded by a base having a periphery with at least one mounting flange projecting laterally from opposite sides of said periphery of said base and said transparent boxes are secured to said front cover core so that said raised interior bubbles project into said display openings, and said bubble includes a lip that extends laterally from opposing sides of its periphery and said lip is separated from said base flanges by a distance such that said lip and said base flanges grip said front cover core therebetween, and an inner front cover liner is disposed across said bases of said boxes to define separate, hollow enclosed cavities within said interior portions of each of said bubbles.

9. A binder according to claim 8 wherein each of said display boxes is formed of a stiff plastic material and said bubbles are shaped so that each of said enclosed cavities is shaped as a rectangular prism.

10. A binder according to claim 8 further comprising a three-dimensional object located within each of said hollow cavities.

11. A binder according to claim 8 wherein all of said three-dimensional objects are entrapped loosely within the confines of said hollow cavities.

12. A binder according to claim 11 further comprising an inner front cover liner permanently sealed across said inside surface of said front cover core to thereby permanently entrap said three-dimensional objects within said hollow cavities.

13. A binder according to claim 12 further comprising a hinged panel located at said inside surface of said front cover core and said hinged panel is movable between an open position exposing said bases of said blisters and a closed position residing in contact with said bases of said blisters.

14. A binder for a plurality of pages comprising a stiff, opaque front cover having a front cover core with inside and outside surfaces and a plurality of display openings are defined entirely through said front cover core and are laterally surrounded by said front cover core, and a separate transparent box is located in each of said display openings and each transparent box has a raised interior bubble surrounded by a base having a periphery with at least one mounting flange projecting laterally from opposite sides of said periphery of said base and said transparent boxes are secured to said front cover core so that said raised interior bubbles project into said display openings, and an inner front cover liner is disposed across said bases of said boxes to define separate, hollow enclosed cavities within said interior portions of each of said bubbles, wherein said flanges at said base of said transparent bubbles are secured to said inside surface of said front cover core by adhesive.

15. A shallow box binder cover comprising: a stiff, opaque front cover core having inside and outside planar surfaces and it least one display opening defined therethrough so that said display opening is laterally surrounded by said front cover core, a shallow transparent tray defining a roof, walls, and laterally projecting planar feet extending away from said walls, and said transparent tray is positioned in said display opening with said roof located proximate said outside surface of said front cover core and said feet located in contact with said inside surface of said front cover core, and an inner front cover liner that covers said inside surface of said front cover core and that extends across said tray in contact with said inside surface of said front cover core to thereby define a hollow, encapsulated cavity bounded by said roof of said transparent tray, said walls of said tray, and said inner front cover liner, and wherein said front cover liner is permanently sealed across said feet of said tray.

* * * * *